US010139764B2

(12) United States Patent
Takahashi et al.

(10) Patent No.: US 10,139,764 B2
(45) Date of Patent: Nov. 27, 2018

(54) IMAGE FORMING APPARATUS

(71) Applicant: CANON KABUSHIKI KAISHA, Tokyo (JP)

(72) Inventors: Shun Takahashi, Nagareyama (JP); Shinya Suzuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/400,149

(22) Filed: Jan. 6, 2017

(65) Prior Publication Data

US 2017/0205750 A1 Jul. 20, 2017

(30) Foreign Application Priority Data

Jan. 18, 2016 (JP) ..... 2016-007418

(51) Int. Cl.
*G03G 15/00* (2006.01)
*G03G 15/01* (2006.01)

(52) U.S. Cl.
CPC ..... *G03G 15/5058* (2013.01); *G03G 15/0131* (2013.01); *G03G 15/0189* (2013.01); *G03G 15/6561* (2013.01); *G03G 2215/0161* (2013.01)

(58) Field of Classification Search
CPC ..... G03G 15/5058; G03G 2215/0158
See application file for complete search history.

(56) References Cited

U.S. PATENT DOCUMENTS

| | | | | |
|---|---|---|---|---|
| 8,587,627 | B2 | 11/2013 | Takahashi et al. | |
| 9,098,041 | B2 | 8/2015 | Suzuki | |
| 9,291,973 | B2 | 3/2016 | Kakutani et al. | |
| 2014/0079443 | A1* | 3/2014 | Nanai | G03G 15/5058 399/301 |
| 2017/0336737 | A1 | 11/2017 | Takahashi | |

FOREIGN PATENT DOCUMENTS

JP 2007-148080 A 6/2007

* cited by examiner

*Primary Examiner* — Erika J Villaluna
(74) *Attorney, Agent, or Firm* — Fitzpatrick, Cella, Harper & Scinto

(57) ABSTRACT

To suppress the wrong detection of the image pattern, an image forming apparatus includes a plurality of image forming units respectively configured to form images of different colors, an intermediate transfer member to which a pattern to detect an amount of color misregistration of an image formed by the plurality of image forming units is transferred, a sensor configured to assure reflected light from the pattern on the intermediate transfer member to output an output value in accordance with a measurement result, a comparator configured to compare the output value output from the sensor with a threshold, and a controller configured to control the plurality of image forming units to respectively form a plurality of patterns of different colors on the intermediate transfer member, to control the sensor to measure reflected light from the plurality of patterns.

10 Claims, 11 Drawing Sheets

IMAGE FORMING APPARATUS

BACKGROUND OF THE INVENTION

Field of the Invention

The present disclosure relates to color misregistration correction control of an image formed by an image forming apparatus.

Description of the Related Art

The image forming apparatus forms a color image by, for example, forming toner images of different colors on a plurality of photoreceptors and overlappingly transferring the toner images on a recording medium such as a sheet. The image forming apparatus may directly transfer the toner image to the recording medium from the plurality of photoreceptors. Alternatively, the image forming apparatus may transfer the toner image to an intermediate transfer member from the photoreceptor. Thereafter, the image forming apparatus may secondarily transfer the toner image to the recording medium from the intermediate transfer member.

The image forming apparatus as mentioned is configured such that the toner images formed on each of the plurality of photoreceptors accurately overlap each other. However, due to component tolerance of the image forming apparatus and/or influence of a change in position of the component caused by a temperature change when forming the image and the like, a situation in which the toner image may not overlap each other on the recording medium, i.e., color misregistration, may occur. Thereby, the image forming apparatus performs control for correcting the color misregistration.

To perform the color misregistration correction control, for example, the image forming apparatus forms a color misregistration pattern (measurement image) for each color on an image carrier such as the intermediate transfer member. Then, the image forming apparatus measures a relative position of the image pattern of each color. The image forming apparatus calculates an amount of color misregistration based on the relative position of the image pattern of each color. Then, to reduce the amount of color misregistration, the image forming apparatus corrects an image forming position of the toner image of each color.

The color misregistration pattern is measured by an optical sensor. The optical sensor has a light emitting part and a light receiving part. When measuring the color misregistration pattern formed on the intermediate transfer member, the optical sensor irradiates light to a region where the image pattern is not formed and to the image pattern of the intermediate transfer member from the light emitting part. Then, the optical sensor receives its reflected light through the light receiving part. The light receiving part outputs analog signals in accordance with light intensity of the reflected light (a reflected light amount) to be received. Thereby, the light receiving part outputs the different analog signals in accordance with the reflected light from the intermediate transfer member and the reflected light amount from the image pattern. The image forming apparatus compares a value of the analog signal which is output from the light receiving part with a threshold to convert the analog signal into a digital signal (binary). Based on the digital signal, the image forming apparatus detects the relative position of the color misregistration pattern of each color on the intermediate transfer member.

The intermediate transfer member wears when the toner image is transferred to the recording medium. The intermediate transfer member also wears when the toner on the intermediate transfer member is removed by a cleaning unit.

Further, toner and paper dust may adhere to a surface of the intermediate transfer member. When the intermediate transfer member wears or the toner and the paper dust adhere on the surface of the intermediate transfer member, the optical sensor may find it impossible to accurately detect the relative position of the image pattern. In particular, surface reflectance of the intermediate transfer member is reduced so that the reflected light amount is reduced. Due to this, a difference between the reflected light amount by the image pattern and the reflected light amount of the intermediate transfer member is reduced. This makes it difficult to accurately detect the position of the image pattern. Thereby, the image forming apparatus finds it difficult to accurately correct the color misregistration.

To suppress influence of the reduction of the reflectance of the intermediate transfer member, Japanese Patent Application Laid-open No. 2007-148080 is proposed. The image forming apparatus described in the Japanese Patent Application Laid-open No. 2007-148080 varies the threshold such that the threshold for converting the analog signal which is output from the optical sensor into the digital signal becomes a value which is lower than a minimum value of the analog signal in accordance with the reflected light amount of the intermediate transfer member.

In manufacturing the intermediate transfer member, an area of locally different reflectance may be generated. Thereby, when performing the color misregistration correction using the intermediate transfer member which is just after the start of use, it is necessary to set the threshold taking into consideration of the local variation of reflectance. However, the image forming apparatus described in the Japanese Patent Application Laid-open No. 2007-148080 determines the threshold based on the same calculation method, which might result in wrongly detecting the area of locally different reflectance as the image pattern. Thereby, it is impossible to accurately detect the position of the image pattern for color misregistration correction, which may decrease the accuracy of the color misregistration correction control. So, the purpose of the present disclosure is to suppress the wrong detection of the image pattern.

SUMMARY OF THE INVENTION

An image forming apparatus according to the present disclosure includes: a plurality of image forming units configured to form images, each having a different color; an intermediate transfer member to which a pattern amount of color misregistration formed by the plurality of image forming units is transferred, the pattern being used for detecting color misregistration; a sensor configured to measure reflected light from the pattern on the intermediate transfer member to output an output value in accordance with a measurement result; a comparator configured to compare the output value output from the sensor with a threshold; and a controller configured to control the plurality of image forming units to form a plurality of patterns, each having a different color, on the intermediate transfer member, to control the sensor to measure reflected light from the plurality of patterns, to compare an output value corresponding to the plurality of patterns output from the sensor with the threshold using the comparator, to detect an amount of color misregistration, related to a relative position of a pattern having a reference color among the plurality of patterns and a color pattern having another color among the plurality of patterns based on a comparison result of the comparator, and, to correct an image forming position of the another color based on the amount of color misregistration, wherein the controller controls whether to change the threshold or not based on an output value corresponding to a measurement result of the reflected light from another pattern which is different from the plurality of patterns output from the sensor.

Further features of the present invention will become apparent from the following description of exemplary embodiments (with reference to the attached drawings).

DESCRIPTION OF THE EMBODIMENTS

In the following, embodiments are described in detail with reference to the accompanying drawings.

Configuration

Figure 1:
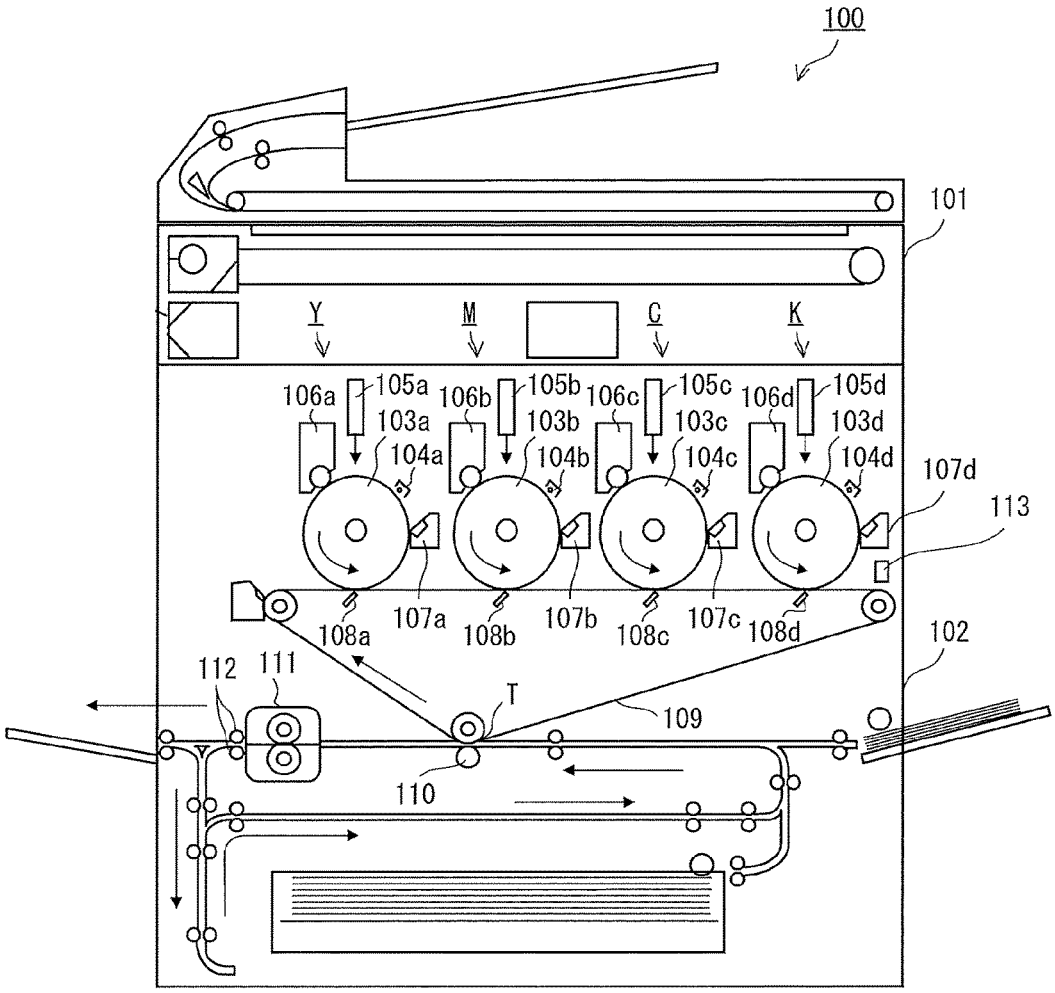
FIG. 1 is a configuration diagram of an image forming apparatus.

FIG. 1 is a configuration diagram of an image forming apparatus 100 according to the present embodiment. The image forming apparatus 100 is an electrophotographic type full color printer. The image forming apparatus 100 comprises a reader section 101 and a printer section 102. The reader section 101 is a scanner, for example, which generates image data based on an original image read from an original. The printer section 102 forms an image on a recording medium such as a sheet based on the image data generated in the reader section 101.

To form toner images of each color of yellow (Y), magenta (M), cyan (C), and black (Bk), the printer section 102 comprises image forming units Y, M, C and K, which respectively correspond to each color in order. Each of the image forming units Y, M, C and K is identical in configuration. Only difference therebetween is the color of the toner image to be formed.

The image forming unit Y comprises a photosensitive drum 103*a* which is to be an image carrier which carries the toner image of yellow. The photosensitive drum 103*a* is a drum-like photoreceptor. A charger 104*a*, an exposure unit 105*a*, a developing device 106*a*, and a cleaner 107*a* are provided around the photosensitive drum 103*a*. The charger 104*a* charges a surface of the photosensitive drum 103*a*. The exposure unit 105*a* scans the photosensitive drum 103*a* with laser beam which is modulated based on the image data of yellow to form an electrostatic latent image on the photosensitive drum 103*a*. The developing device 106*a* develops the electrostatic latent image with the toner of yellow to form the toner image of yellow on the photosensitive drum 103*a*. The cleaner 107*a* cleans toner which remains on the photosensitive drum 103*a* after transferring the toner image to an intermediate transfer belt 109 (described later).

An image forming unit M comprises a photosensitive drum 103*b*, a charger 104*b*, an exposure unit 105*b*, a developing device 106*b*, and a cleaner 107*b*. The image forming unit M forms the toner image of magenta on the photosensitive drum 103*b*. The image forming unit C comprises a photosensitive drum 103*c*, a charger 104*c*, an exposure unit 105*c*, a developing device 106*c*, and a cleaner 107*c*. The image forming unit C forms the toner image of cyan on the photosensitive drum 103*c*. An image forming unit K comprises a photosensitive drum 103*d*, a charger 104*d*, an exposure unit 105*d*, a developing device 106*d*, and a cleaner 107*d*. The image forming unit K forms the toner image of black on the photosensitive drum 103*d*.

The intermediate transfer belt 109 is provided below each of the image forming units Y, M, C, and K. The intermediate transfer belt 109 is the intermediate transfer member to which the toner image of each color formed on each of the photosensitive drums 103*a*, 103*b*, 103*c* and 103*d* is transferred and which is to be an image carrier which carries the full color toner image. Transfer blades 108*a*, 108*b*, 108*c*, and 108*d* are provided at positions opposing each of the photosensitive drums 103*a*, 103*b*, 103*c*, and 103*d* with the intermediate transfer belt 109 interposed therebetween.

The toner image of yellow formed on the photosensitive drum 103*a* is transferred to the intermediate transfer belt 109 by a transfer bias which is applied to the transfer blade 108*a*. The toner image of magenta formed on the photosensitive drum 103*b* is transferred to the intermediate transfer belt 109 by the transfer bias which is applied to the transfer blade 108*b*. The toner image of cyan formed on the photosensitive drum 103*c* is transferred to the intermediate transfer belt 109 by the transfer bias which is applied to the transfer blade 108*c*. The toner image of black formed on the photosensitive drum 103*d* is transferred to the intermediate transfer belt 109 by the transfer bias which is applied to the transfer blade 108*d*. Due to the above, the toner image of each color is formed on the intermediate transfer belt 109.

A secondary transfer section T is formed between the intermediate transfer belt 109 and the secondary transfer roller 110. In FIG. 1, the intermediate transfer belt 109 rotates clockwise. The intermediate transfer belt 109 conveys the toner images transferred from each of the photosensitive drums 103*a*, 103*b*, 103*c*, and 103*d* to the secondary transfer section T. The recording medium is conveyed to the secondary transfer section T in accordance with timing at which the toner image is conveyed. The recording medium is conveyed between the intermediate transfer belt 109 and the secondary transfer roller 110, which enables a batch transfer of the toner image of each color from the intermediate transfer belt 109.

A fixing device 111 is provided on a downstream side in a conveying direction of the recording medium. The fixing device 111 fixes the toner image on the recording medium to which the toner image is transferred. For example, the fixing device 111 fixes the toner image on the recording medium by heating and pressurizing the recording medium. The recording medium on which the toner image is fixed is delivered outside the image forming apparatus 100 by a delivery roller 112 and the like from the fixing device 111.

It is noted that the image forming unit K for forming the toner image of black is provided nearer to the secondary transfer section T side than the rest of the image forming units Y, M, and C in a rotation direction of the intermediate transfer belt 109. With such arrangement, when forming a monochromatic image, it is possible to suppress time from an instruction to form an image to a delivery of the recording medium on which the image is formed.

An optical sensor 113 is provided nearer to the secondary transfer section side T than the image forming unit K in the rotation direction of the intermediate transfer belt 109. The optical sensor 113 detects an image pattern which is the toner image for color misregistration detection formed on the intermediate transfer belt 109.

Figure 2:
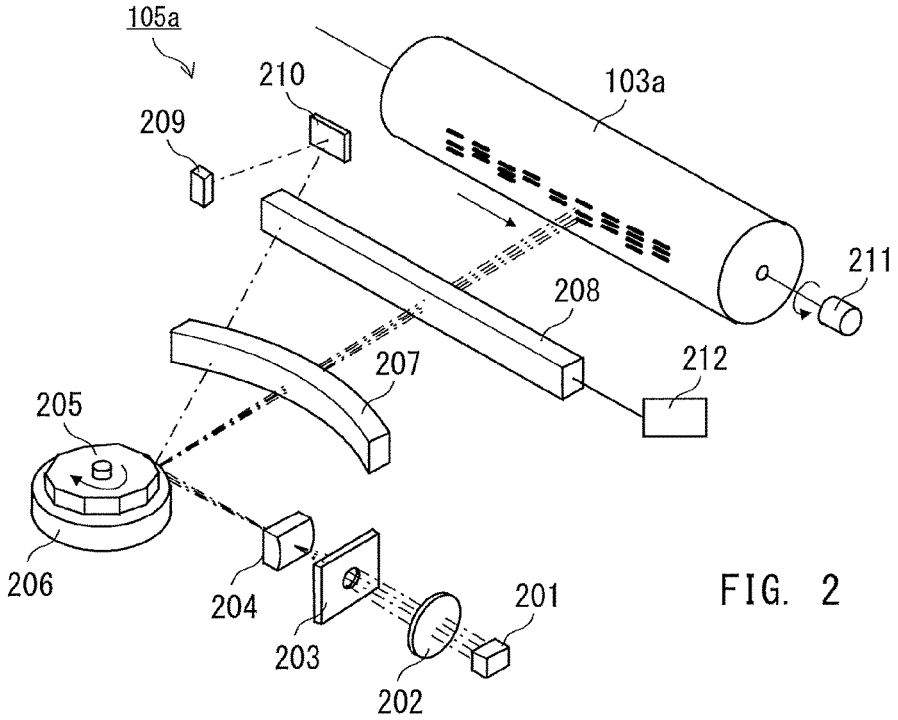
FIG. 2 is an explanatory diagram of an exposure unit.

FIG. 2 is an explanatory diagram of the exposure unit 105*a*. It is noted that the exposure unit 105*a* and the exposure units 105*b*, 105*c*, and 105*d* are in the same configuration. Here, a description is provided with regard to the exposure unit 105*a* and the description with regard to the exposure units 105*b*, 105*c*, and 105*d* is omitted.

The exposure unit 105*a* comprises a semiconductor laser 201 as a light source, a collimator lens 202, an aperture diaphragm 203, a cylindrical lens 204, a rotating polygon mirror 205, a rotating polygon mirror driving part 206, a toric lens 207, and a diffraction optical element 208. Further, to suppress scanning timing of the photosensitive drum 103*a* by the laser beam, the exposure unit 105*a* comprises a reflection mirror 210 and a beam detector 209.

The collimator lens 202 converts the laser beam emitted from the semiconductor laser 201 into parallel luminous flux. The aperture diaphragm 203 limits the luminous flux of the passing laser beam. The cylindrical lens 204 has a predetermined refractive power only in a sub-scanning direction. The cylindrical lens 204 images the luminous flux having passed the aperture diaphragm 203 on a reflecting surface of the rotating polygon mirror 205 as an elliptical image which is long in a main scanning direction. In FIG. 2, the rotating polygon mirror 205 rotates clockwise at constant speed by the rotating polygon mirror driving part 206. The rotating polygon mirror 205 performs deflection scanning of the laser beam imaged on the reflecting surface. The toric lens 207 is an optical element having fθ characteristic. Refractive index of the toric lens 207 in the main scanning direction is different from that in the sub-scanning direction. Front and rear lens surfaces in the main scanning direction of the toric lens 207 are aspherical shapes. The diffraction optical element 208 is the optical element having fθ characteristic. Magnification of the diffraction optical element 208 in the main scanning direction is different from that in the sub-scanning direction.

The beam detector 209 is provided on a position where corresponds to outside the image forming area of the photosensitive drum 103*a*. The beam detector 209 outputs a scanning timing signal for instructing a scanning start position on the photosensitive drum 103*a* by detecting the laser beam reflected by the reflection mirror 210.

The photosensitive drum 103*a* is rotationally driven around a drum shaft by a drum driving part 211. Spot of the laser beam deflected by the rotating polygon mirror 205 which is rotationally driven is irradiated with the photosensitive drum 103*a* while linearly moving in accordance with the rotation of the rotating polygon mirror 205, setting a direction parallel to the drum shaft as the main scanning direction. Due to this, an electrostatic latent image formation is performed in the main scanning direction of the photosensitive drum 103*a*. The surface of the photosensitive drum 103*a* is charged by the charger 104*a*. Potential of a portion where the laser beam is irradiated varies, resulting in forming the electrostatic latent image. The semiconductor laser 201 of the present embodiment is multi-beam laser which emits a plurality of laser beams. Thereby, with one scanning, a plurality of line-shaped electrostatic latent images can be formed on the photosensitive drum 103*a*. By being rotationally driven by the drum driving part 211, the electrostatic latent image is formed in the sub-scanning direction of the photosensitive drum 103*a*.

The diffraction optical element 208 is a rectangular parallelepiped which extends in the same direction as the drum shaft of the photosensitive drum 103*a*. With a diffraction optical element driving part 212, the diffraction optical element 208 is rotatable with its longitudinal direction as an axis. With the rotation of the diffraction optical element 208, a direction of a scanning line on the photosensitive drum 103 (inclination of a scanning line to the drum shaft of the photosensitive drum 103*a*) and a curve are corrected.

Operation of the semiconductor laser 201, the rotating polygon mirror driving part 206, the drum driving part 211, and the diffraction optical element driving part 212 is controlled by a control unit which is described later.

Color Misregistration

A description is provided with regard to a relative position deviation (color misregistration) caused between each of the toner images which is transferred to the intermediate transfer belt 109 from each of the photosensitive drums 103*a*, 103*b*, 103*c*, and 103*d*. As mentioned, the toner images of yellow, magenta, cyan, and black are formed on the photosensitive drums 103*a*, 103*b*, 103*c*, and 103*d*. The toner images formed on each of the photosensitive drums 103*a*, 103*b*, 103*c*, and 103*d* are overlappingly transferred to the intermediate transfer belt 109. At this time, when the toner images of each color do not accurately overlap each other (in a case where the color misregistration is caused), difference in a color tone is caused between an original image and an output image to be finally formed on the recording medium, which deteriorates image quality.

The image forming apparatus 100 performs the color misregistration correction at timings when it is powered ON, when it recovers from a standby state, when images are formed on a predetermined number (cumulative number) of sheets of recording medium, and the like. The image forming apparatus 100 forms the image pattern which is the toner image for color misregistration detection of each color on the intermediate transfer belt 109. Then, the image forming apparatus 100 detects the image pattern by the optical sensor 113. Based on the detection result, the image forming apparatus 100 performs the color misregistration correction.

Figure 3:
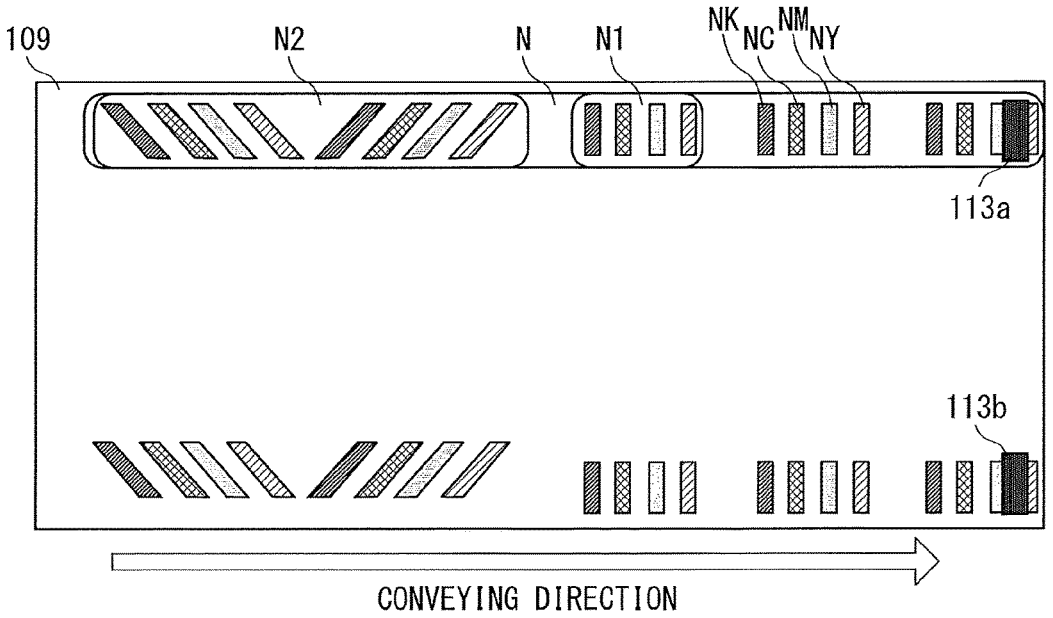
FIG. 3 is an explanatory diagram of a color misregistration pattern.

FIG. 3 is an explanatory diagram of the color misregistration pattern used for the color misregistration correction. As shown in FIG. 3, an image pattern N is formed on the intermediate transfer belt 109. In the image pattern N for color misregistration detection, an image pattern NY for yellow, an image pattern NM for magenta, an image pattern NC for cyan, and an image pattern NK for black are formed at both ends in the main scanning direction of the intermediate transfer belt 109 at a predetermined width and interval so as not to overlap each other. Here, the main scanning direction means a direction which is orthogonal to the rotating direction of the intermediate transfer belt 109. As shown in FIG. 3, the image pattern N is transferred to the intermediate transfer belt 109 from each of the photosensitive drums 103*a*, 103*b*, 103*c*, and 103*d*. The image pattern N includes an image pattern N1 and an image pattern N2, which are comprised of a combination of the image patterns NY, NM, NC, and NK. The image pattern N1 is used to correct the color misregistration in the sub-scanning direction. The image pattern N2 is used to correct the color misregistration in the main scanning direction.

The optical sensor 113 is provided at a position that allows detection of the image pattern N. In the example shown in FIG. 3, two optical sensors 113 (optical sensor 113*a* and 113*b*) are provided corresponding to each image pattern N formed at both ends in the main scanning direction of the intermediate transfer belt 109. When the image pattern N is formed at more positions, the optical sensor 113 is accordingly provided corresponding to the forming position. The optical sensors 113*a* and 113*b* irradiate the intermediate transfer belt 109 and output analog signals representing a detection result in accordance with its reflected light amount. The reflected light amount of the intermediate transfer belt 109 is different in portions where the image pattern N is formed and where the image pattern is not formed. Thereby, the analog signal which is output from a light receiving part 312 takes different detection values in the portions where the image pattern N is formed and where the image pattern is not formed.

When performing the color misregistration correction, the image forming apparatus 100 detects the relative position with the position where the image patterns NM, NC, and NK of the rest of the colors are formed on the basis of the position where the image pattern NY for yellow is formed. In accordance with the relative position of each of the image patterns NY, NM, NC, and NK, the image forming apparatus 100 calculates a relative registration amount. Based on the registration amount, the image forming apparatus 100 performs the color misregistration correction control so as not to cause the registration between the toner images of each color when forming the image.

Control Unit

Figure 4:
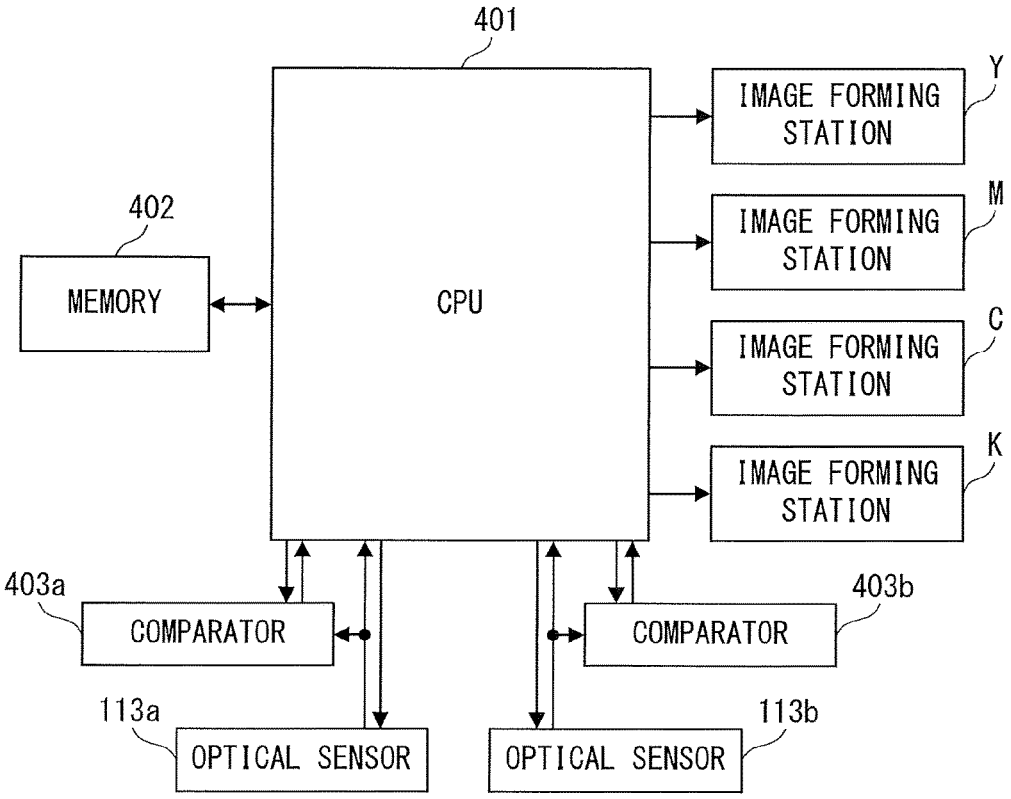
FIG. 4 is a configuration diagram of a control unit.

FIG. 4 is a configuration diagram of a control unit for controlling the operation of the image forming apparatus 100. The control unit is incorporated in the image forming apparatus 100. Here, a description is provided with regard to a configuration of the control unit for performing the color misregistration correction. The control unit comprises a CPU (Central Processing Unit) 401, a memory 402, and comparators 403*a* and 403*b*. Such control unit is realized by a MPU (Micro-Processing Unit), an ASIC (Application Specific Integrated Circuit), a SoC (System-on-a-Chip) and the like. The CPU 401 controls the operation of the image forming apparatus 100 by reading predetermined computer program from the memory 402 and executing the computer program. In the present embodiment, the CPU 401 performs the color misregistration correction control by executing the computer program.

The analog signal which is output from the optical sensor 113*a* is input to the CPU 401 and the comparator 403*a*. The comparator 403*a* converts the obtained analog signal into the digital signal. Then, the comparator 403*a* inputs the digital signal to the CPU 401. The analog signal which is output from the optical sensor 113*b* is input to the CPU 401 and the comparator 403*b*. The comparator 403*b* converts the obtained analog signal into the digital signal. Then, the comparator 403*a* inputs the digital signal to the CPU 401. The optical sensor 113*a* and the optical sensor 113*b* are in the same configuration. The comparator 403*a* and the comparator 403*b* are in the same configuration. In the following, to simplify the description, the optical sensors 113*a* and 113*b* are described as the optical sensor 113. Likewise, the comparators 403*a* and 403*b* are described as a comparator 403.

Based on the analog signal which is obtained from the optical sensor 113, the CPU 401 adjusts the light amount irradiated on the intermediate transfer belt 109 by the optical sensor 113 such that an output value of the optical sensor 113 (detection value of the analog signal) becomes a predetermined value. Details with regard to the light amount adjustment control will be described later. Based on the digital signal obtained from the comparator 403, the CPU 401 detects the relative position of the image patterns NY, NM, NC and NK of each color. Based on the detection result of the relative position, the CPU 401 calculates the registration amount of the relative position of the image patterns NY, NM, NC, and NK of each color. Then, the CPU 401 performs the color misregistration correction control based on the registration amount. The CPU 401 sends signals for correcting the color misregistration to each of the image forming units Y, M, C, and K.

Color Misregistration Correction and Image Forming Processing

Figure 5:
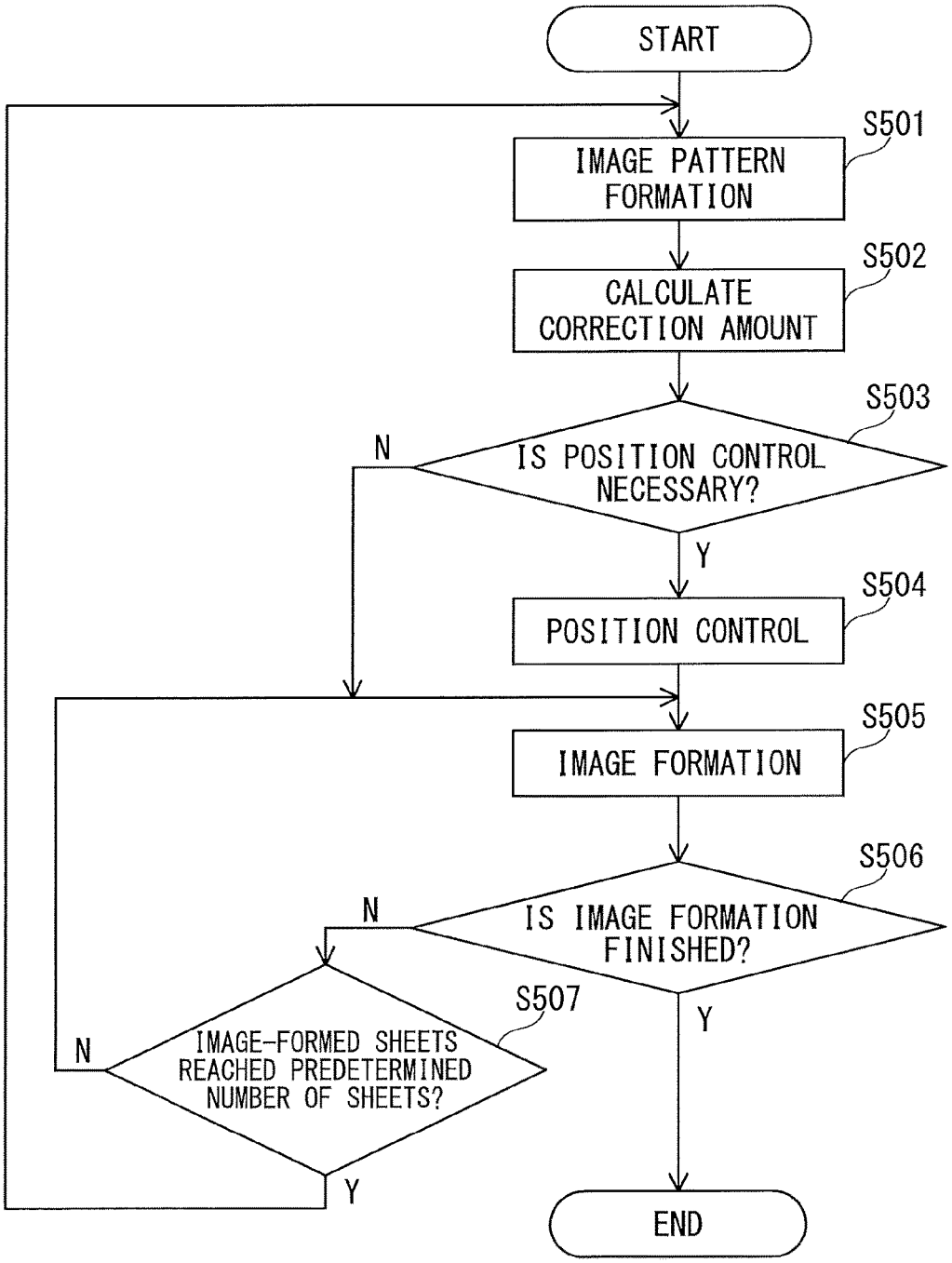
FIG. 5 is a flowchart representing image forming processing including color misregistration correction control processing.

FIG. 5 is a flowchart representing image forming processing including color misregistration correction control processing. As mentioned, the color misregistration correction control is performed when the image forming apparatus 100 is powered ON, when it is recovered from the standby state, when cumulative number of image-formed sheets on the recording medium has reached the predetermined number of sheets, and the like. Here, a description is provided with regard to a case where the color misregistration correction control and the image forming processing are performed after the image forming apparatus recovers from the standby state.

When image data is input from the reader section 101 or an external device, the CPU 401 recovers from the standby state and causes each of the image forming units Y, M, C, and K to form the image pattern N for color misregistration correction (Step S501). Each of the image forming units Y, M, C, and K forms the image patterns NY, NM, NC, and NK of the corresponding color on the photosensitive drums 103*a*, 103*b*, 103*c*, and 103*d*, which are then transferred to the intermediate transfer belt 109. Due to this, as shown in FIG. 3, the image pattern N for color misregistration correction is formed on the intermediate transfer belt 109.

The image pattern N is detected by the optical sensor 113. The optical sensor 113 inputs the analog signal representing the detection result to the comparator 403. The comparator 403 converts the analog signal obtained from the optical sensor 113 into the digital signal based on the predetermined threshold. Then, the comparator 403 inputs the digital signal to the CPU 401. Based on the digital signal obtained from the comparator 403, the CPU 401 calculates the color misregistration correction amount (Step S502).

The CPU 401 determines whether it is necessary or not to control a position of an optical system such as various lenses and reflection mirror provided with the exposure units 105*a*, 105*b*, 105*c*, and 105*d* (Step S503). In the present embodiment, the CPU 401 determines whether it is necessary or not to change the position of the diffraction optical element 208. If it is determined that it is necessary to control the position of the optical system (Step S503: Y), the CPU 401 instructs each of the image forming units Y, M, C, and K to control the position of the optical system. In accordance with the instruction, each of the image forming units Y, M, C, and K controls the position of the optical system of the exposure units 105*a*, 105*b*, 105*c*, and 105*d* (Step S504). In the present embodiment, in accordance with the instruction from the CPU 401, the diffraction optical element driving part 212 controls the position of the diffraction optical element 208. It is noted that the method to correct the image forming position of each color is not limited to using the diffraction optical element 208. For example, a known art of changing the image data based on the color misregistration correction amount may be used.

If it is determined that it is not necessary to control the position (Step S503: N), or after the position control is finished, the CPU 401 instructs each of the image forming units Y, M, C, and K to perform the image forming processing based on the color misregistration correction amount. In accordance with the instruction, each of the image forming units Y, M, C, and K adjusts the irradiation timing of the semiconductor laser 201 of the exposure units 105*a*, 105*b*, 105*c*, and 105*d* based on the color misregistration correction amount to perform the image formation (Step S505).

The CPU 401 determines whether or not all the images are finished being formed based on the image data every time the image is formed on one sheet of recording medium (Step S506). If it is determined that all the images are finished being formed based on the image data (Step S506: Y), the CPU 401 ends the image forming processing.

If it is determined that all the images are not finished being formed based on the image data (Step S506: N), the CPU 401 determines whether the cumulative number of image-formed sheets on the recording medium has reached the predetermined number of sheets or not (Step S507). If it is determined that the cumulative number of image-formed sheets on the recording medium has reached the predetermined number of sheets (Step S507: Y), the CPU 401 repeatedly performs the processing after the Step S501. It means that the CPU 401 performs the color misregistration correction processing as the cumulative number of image-formed sheets on the recording medium has reached the predetermined number of sheets. If it is determined that the cumulative number of image-formed sheets has not reached the predetermined number of sheets (Step S507: N), the CPU 401 repeatedly performs the processing after the Step S505. It means that the CPU 401 repeatedly performs the image forming processing. It is noted that the CPU 401 stores temperature information beforehand when the color misregistration correction control is performed last time. The CPU 401 performs the color misregistration correction control even in a case where difference between current temperature and the stored temperature becomes larger than predetermined temperature.

Optical Sensor

Figure 6:
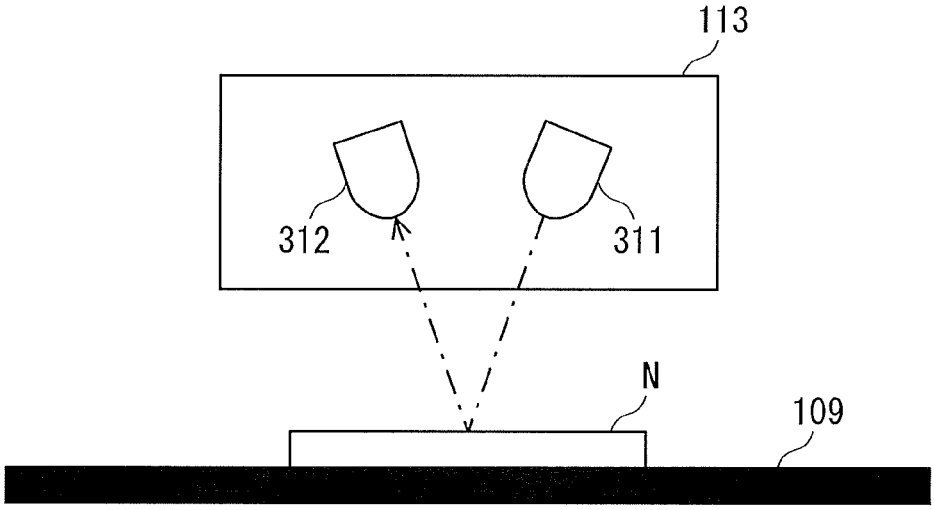
FIG. 6 is an explanatory diagram of the optical sensor.

FIG. 6 is an explanatory diagram of the optical sensor 113. The optical sensor 113 comprises a light emitting part 311 and a light receiving part 312. The light emitting part 311 irradiates light toward the intermediate transfer belt 109. The light receiving part 312 receives reflected light from the intermediate transfer belt 109 and outputs the analog signal based on a light reception result. The optical sensor 113 functions as a measuring unit for measuring the image pattern N formed on the intermediate transfer belt 109 based on the analog signal (detection value) which is output from the light receiving part 312. The measurement result of the optical sensor 113 corresponds to the analog signal (detection value).

As a system to detect the reflected light, the optical sensor 113 for detecting the image pattern N for color misregistration detection has two systems. One is to detect regular reflected light and the other is to detect irregular reflected light (diffused reflected light). In the present embodiment, the optical sensor 113 detects the regular reflected light through the light receiving part 312. To allow receiving the regular reflected light of the light irradiated toward the intermediate transfer belt 109 from the light emitting part 311, the light receiving part 312 is arranged such a position where an incident angle and a reflection angle of the light irradiated from the light emitting part 311 to the intermediate transfer belt 109 become equal. The light receiving part 312 outputs the analog signal representing the detection value in accordance with the reflected light amount.

Due to the adhesion of the toner and the paper dust and influence of the cleaning of the remaining toner, gloss of the surface of the intermediate transfer belt 109 is reduced, which varies the surface reflectance of the intermediate transfer belt 109. The optical sensor 113 is easily influenced by the variation of the surface reflectance of the intermediate transfer belt 109. Thereby, to suppress the influence, correction of adjusting the irradiated light amount of the light emitting part 311 and density of the image pattern N becomes necessary.

Figure 7:
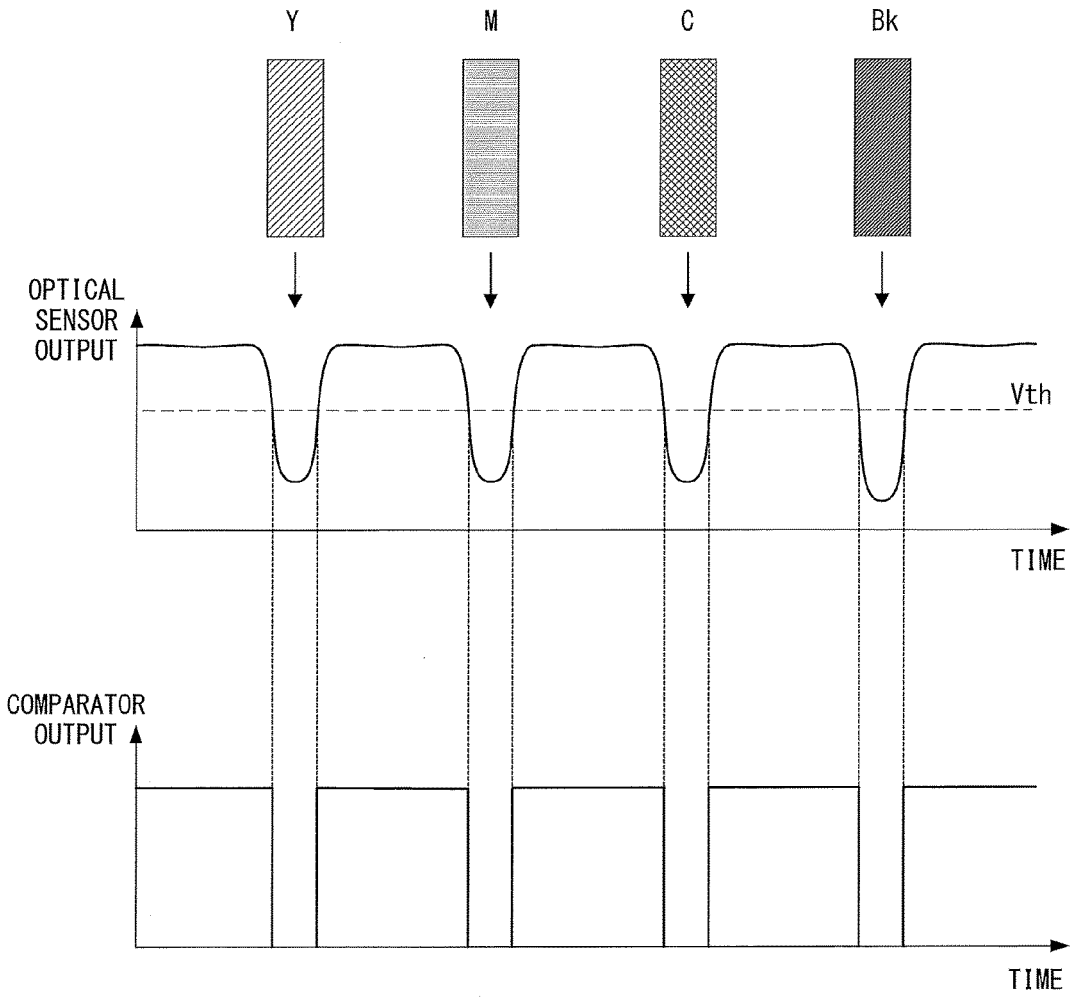
FIG. 7 is an explanatory diagram of the analog signal and the digital signal.

FIG. 7 shows one example of a measurement result of the image pattern N formed on the intermediate transfer belt 109 by the optical sensor 113 in an ideal state in which no local variation of reflectance is caused on the intermediate transfer belt 109. FIG. 7 shows the analog signal which is output from the optical sensor 113 and the digital signal which is converted to be output from the analog signal by the comparator 403.

To detect the regular reflected light by the optical sensor 113, the analog signal (detection value) which corresponds to the reflected light from the intermediate transfer belt 109 becomes higher than a threshold Vth. The analog signal (detection value) which corresponds to the reflected light from the image pattern N becomes lower than the threshold Vth. Based on the threshold Vth, the comparator 403 converts the analog signal into the digital signal. When the optical sensor 113 detects the intermediate transfer belt 109, the digital signal turns to high level. When the optical sensor 113 detects a portion of the image pattern N, the digital signal turns to low level. The CPU 401 reads to set the threshold Vth from the memory 402.

Figure 8:
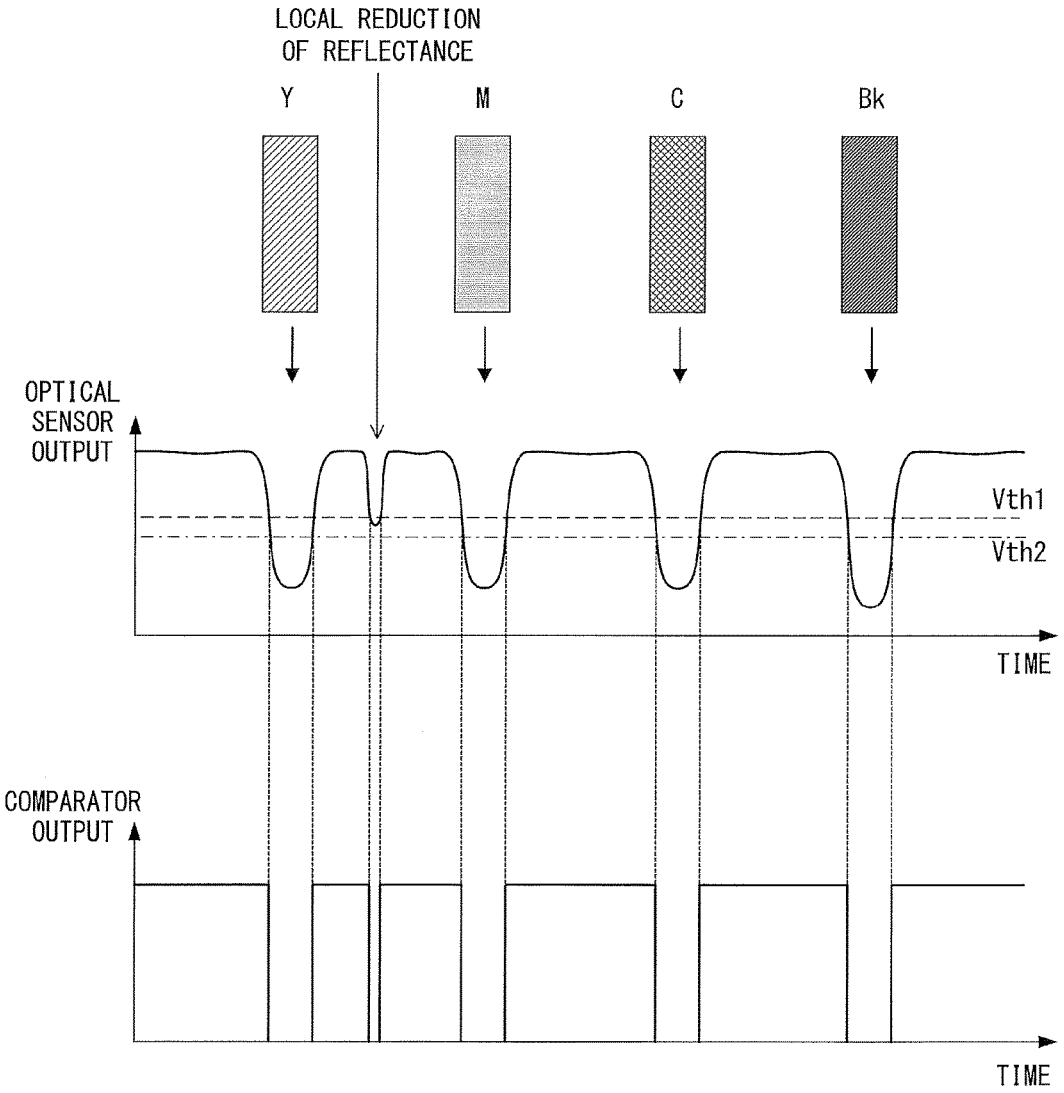
FIG. 8 is an explanatory diagram of the analog signal and the digital signal.

FIG. 8 shows one example of a measurement result of the image pattern N formed on the intermediate transfer belt 109 by the optical sensor 113 in a state in which the local variation (reduction) of reflectance is caused on the intermediate transfer belt 109. FIG. 8 shows the analog signal which is output from the optical sensor 113 and the digital signal which is converted to be output from the analog signal by the comparator 403. In a process of manufacturing the intermediate transfer belt 109, the surface reflectance of the intermediate transfer belt 109 may vary (reduce) locally.

Due to the local reduction of the reflectance, the analog signal which is output from the optical sensor 113 becomes lower than the threshold Vth of the analog signal (detection value) which corresponds to a region where the reflectance is reduced. For example, in a case where a threshold Vth1 which is the same as the threshold Vth in FIG. 7 is used, the comparator 403 converts the analog signal which corresponds to the region where the reflectance is locally reduced into the digital signal of low level. In this case, the CPU 401 cannot normally perform the color misregistration correction control.

Thereby, in a state in which the local variation (reduction) of reflectance is caused on the intermediate transfer belt 109, the comparator 403 converts the analog signal into the digital signal based on a threshold Vth2 which is lower than the threshold Vth1. Due to this, the comparator 403 can convert the analog signal which corresponds to the region where the reflectance is locally reduced into the digital signal of high level. The CPU 401 reads to set the thresholds Vth1 and Vth2 from the memory 402. As mentioned, in a case where the local variation of reflectance is caused on the intermediate transfer belt 109, by changing the threshold to be set in the comparator 403, it becomes possible to accurately detect the image pattern N. It is noted that, the low-level digital signal due to the local reduction of the reflectance is different from the low-level digital signal when the image pattern N is detected in a time width. Based on the time width, the CPU 401 determines whether the local reduction of the reflectance is caused or not, and sets the threshold.

Due to a change with time of the intermediate transfer belt 109 and the adhesion of the paper dust and the like, the surface reflectance of the intermediate transfer belt 109 is entirely reduced. Due to the reduction of the reflectance, the analog signal (detection value) which is output by the optical sensor 113 may be reduced so that the detection value may become lower than the threshold set in the comparator 403. Thereby, the optical sensor 113 needs to adjust the light amount irradiated to the intermediate transfer belt 109 to adjust the detection value. In the following, a description with regard to the light amount adjustment control is provided.

Figure 9A:
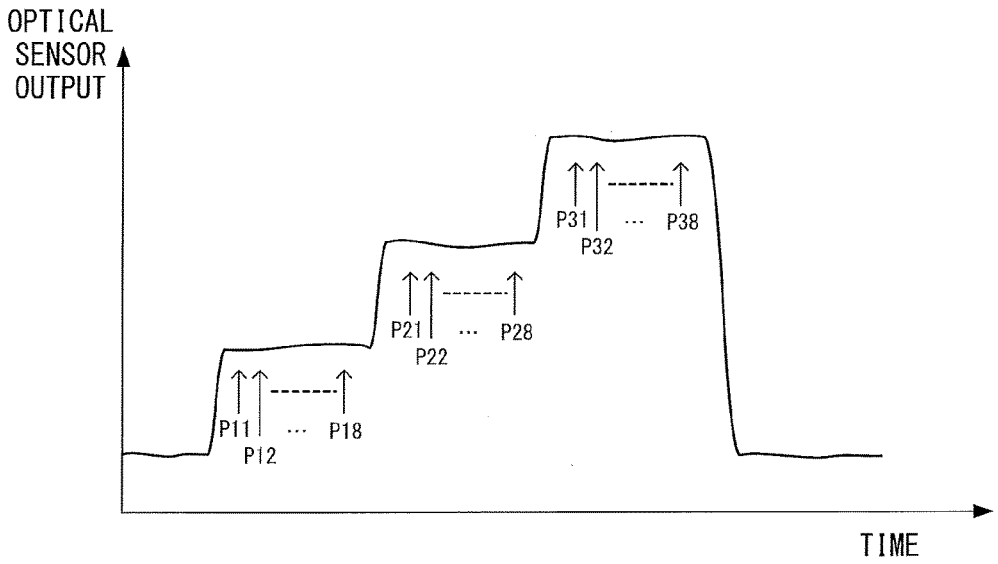
FIGS. 9A and 9B are explanatory diagrams of a target light amount setting.
Figure 9B:
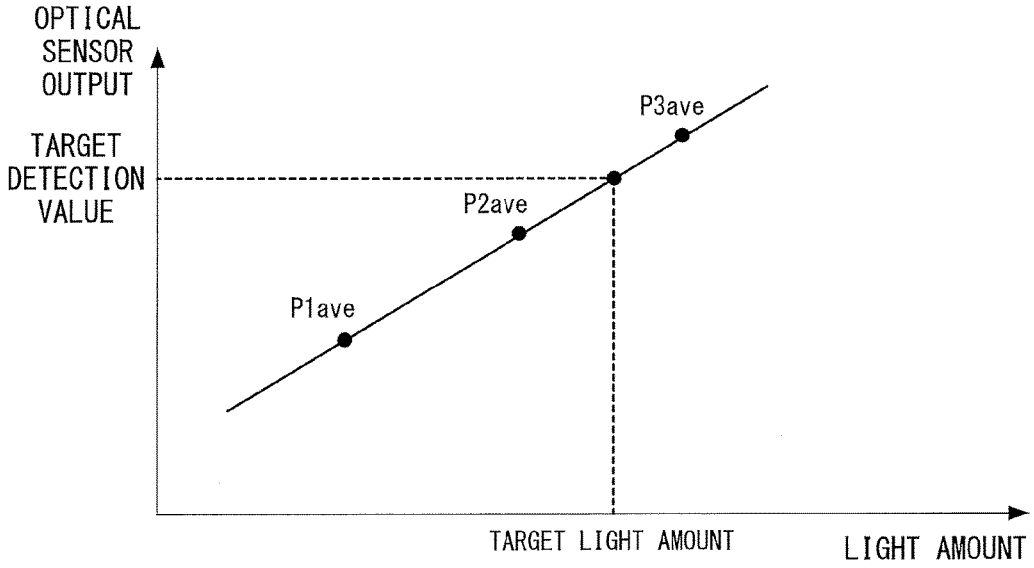

FIG. 9A and FIG. 9B are diagrams explaining target light amount setting when adjusting the light amount. The light emitting part 311 of the optical sensor 113 emits light with a light amount which corresponds to a current amount applied in accordance with the instruction from the CPU 401. In accordance with the light amount emitted by the optical sensor 113, the analog signal (detection value) which is output by the optical sensor varies.

When adjusting the light amount, the CPU 401 varies the current amount applied to the light emitting part 311 in three levels. Due to this, the light emitting part 311 emits light with the light amount of three levels. FIG. 9A represents a waveform of the analog signal which is output from the light receiving part 312 in a case where the light amount of the light emitting part 311 is varied in three levels and the reflected light from the intermediate transfer belt 109 is received through the light receiving part 312. As shown in FIG. 9A, in accordance with the light amount emitted by the light emitting part 311, the analog signal takes three values, which are: the detection value shown from P11 to P18, the detection value shown from P21 to P28, and the detection shown from P31 to P38. The analog signal from P11 to P18 shows the waveform in a case where the smallest current amount is applied to the light emitting part 311. The analog signal from P31 to P38 shows the waveform in a case where the largest current amount is applied to the light emitting part 311. The analog signal from P21 to P28 shows the waveform in a case where the current amount in between is applied to the light emitting part 311.

FIG. 9B is an explanatory diagram of a method to determine the target light amount after adjusting the light amount. In accordance with the analog signal which is output from the light receiving part 312, the CPU 401 calculates the target light amount. The CPU 401 detects the three detection values which correspond to the three-level light amount. In the present embodiment, an average value P1*ave*, which is the average value from P11 to P18, an average value P2*ave*, which is the average value from P21 to P28, and an average value P3*ave*, which is the average value from P31 to P38 are detected as the three detection values which correspond to the three-level light amount.

As shown in FIG. 9B, the three average values P1*ave*, P2*ave*, and P3*ave*, which are the three detection values, are in almost linear relation. The light amount which corresponds to the target detection value of the analog signal on the straight line is the target light amount. If any of the average values of P1*ave*, P2*ave*, and P3*ave* is the target detection value, the CPU 401 sets the light amount which corresponds to the value as the target light amount. If none of the average values of P1*ave*, P2*ave*, and P3*ave* is the target detection value, the CPU 401 performs linear interpolation of the average values P1*ave*, P2*ave*, and P3*ave* to determine the target light amount so that the detection value becomes the target detection value. The CPU 401 applies the current amount to the light emitting part 311. The current amount to be applied is the amount which allows the light emitting part 311 to emit light with the target light amount determined in this manner.

With the light amount adjustment as mentioned the light amount of the light irradiated by the optical sensor 113 when performing the color misregistration correction is determined. Thereby, the image forming apparatus 100 can suppress influence on the detection accuracy of the image pattern N due to the change of a state of the surface of the intermediate transfer belt 109. It is noted that the light amount adjustment of the optical sensor 113 is not always executed at the same timing as that the color misregistration correction control is executed. To suppress downtime when the light amount adjustment control and the color misregistration correction control are continuously executed, the CPU 401 executes the light amount adjustment control at different timing from the color misregistration correction control.

Figure 10:
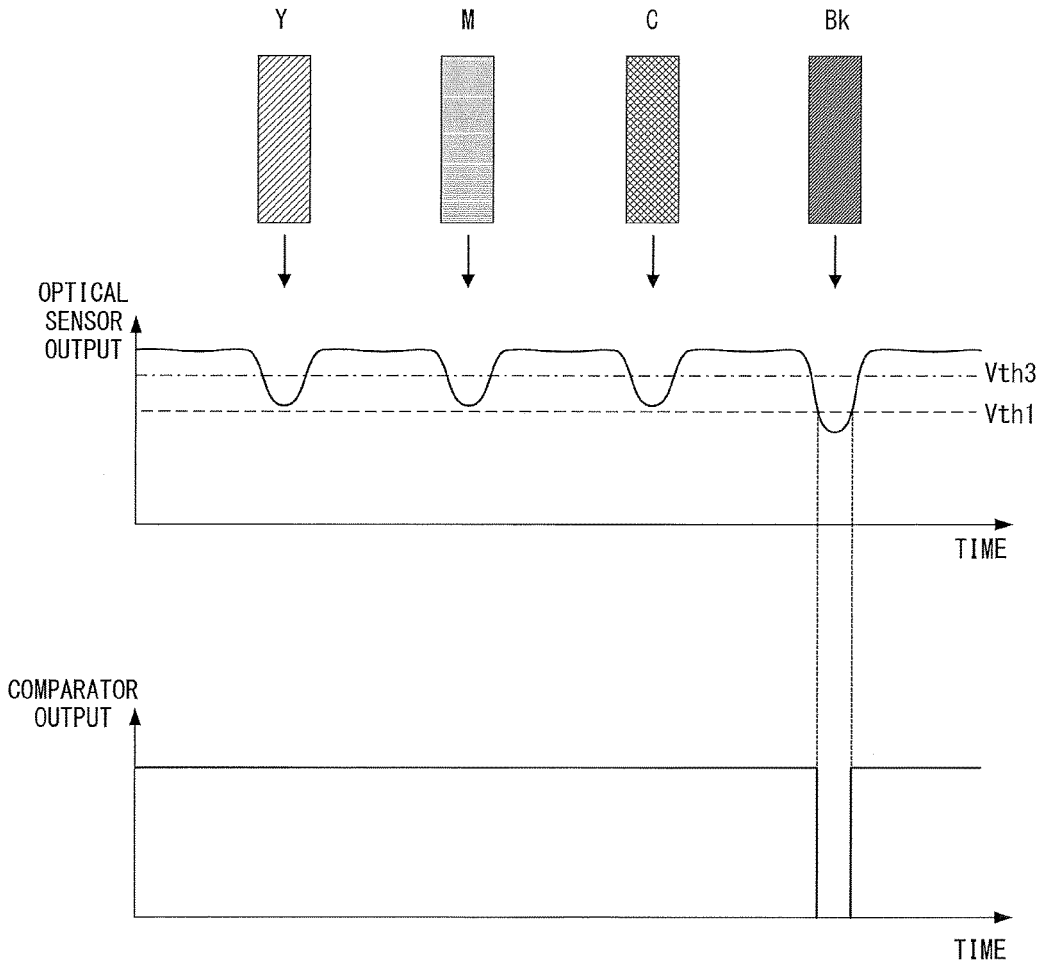
FIG. 10 is an explanatory diagram of the analog signal and the digital signal.

FIG. 10 is one example of a measurement result of the image pattern N formed on the intermediate transfer belt 109 by the optical sensor 113 in a case where the intermediate transfer belt 109 has changed with time. FIG. 10 shows the analog signal which is output from the optical sensor 113 and the digital signal which is converted to be output from the analog signal by the comparator 403. Due to the change with time, the surface reflectance of the intermediate transfer belt 109 is entirely varied (reduced). The entire reduction of the reflectance makes it relatively difficult to see the local reduction of the reflectance. Further, as the detection value which is output from the optical sensor 113 is reduced, difference between the detection value which corresponds to the intermediate transfer belt 109 and the detection value which corresponds to the image pattern N is reduced. As shown in FIG. 10, in a case where the light emitting part 311 emits light with the target light amount by the light amount adjustment, the difference between the detection value which corresponds to the intermediate transfer belt 109 and the detection value which corresponds to the image pattern N is reduced and the detection value becomes high as a whole.

In a case where the threshold Vth1 which is the same value as the threshold Vth shown in FIG. 7 is set in the comparator 403, the analog signal which corresponds to the image pattern NK for black is below the threshold Vth1 and the analog signal which corresponds to the image patterns NY, NM, and NC for the rest of the colors exceeds the threshold Vth1. As a result, as to the digital signal which is output from the comparator 403, only the image pattern NK for black turns to low level and the image patterns NY, NM, and NC for the rest of the colors turn to high level. With such digital signals, the CPU 401 cannot normally perform the color misregistration correction.

Thereby, the CPU 401 sets a threshold Vth3 which is a value different from the threshold Vth1 in the comparator 403. The threshold Vth3 is a value higher than the threshold Vth1. As the threshold Vth3 is set, the comparator 403 converts the analog signal which corresponds to the image patterns NY, NM, and NC into the digital signal of low level. Thereby, even in a case where the difference between the detection value which corresponds to the intermediate transfer belt 109 and the detection value which corresponds to the image pattern N is reduced, the CPU 401 can detect the image pattern. As mentioned, in a case where the color misregistration correction is performed using the intermediate transfer belt 109 whose reflectance is reduced due to the change with time, as a dynamic range of the analog signal which is output from the optical sensor 113 is reduced, it is necessary to increase the threshold set in the comparator 403.

Threshold Setting Processing 1

Figure 11:
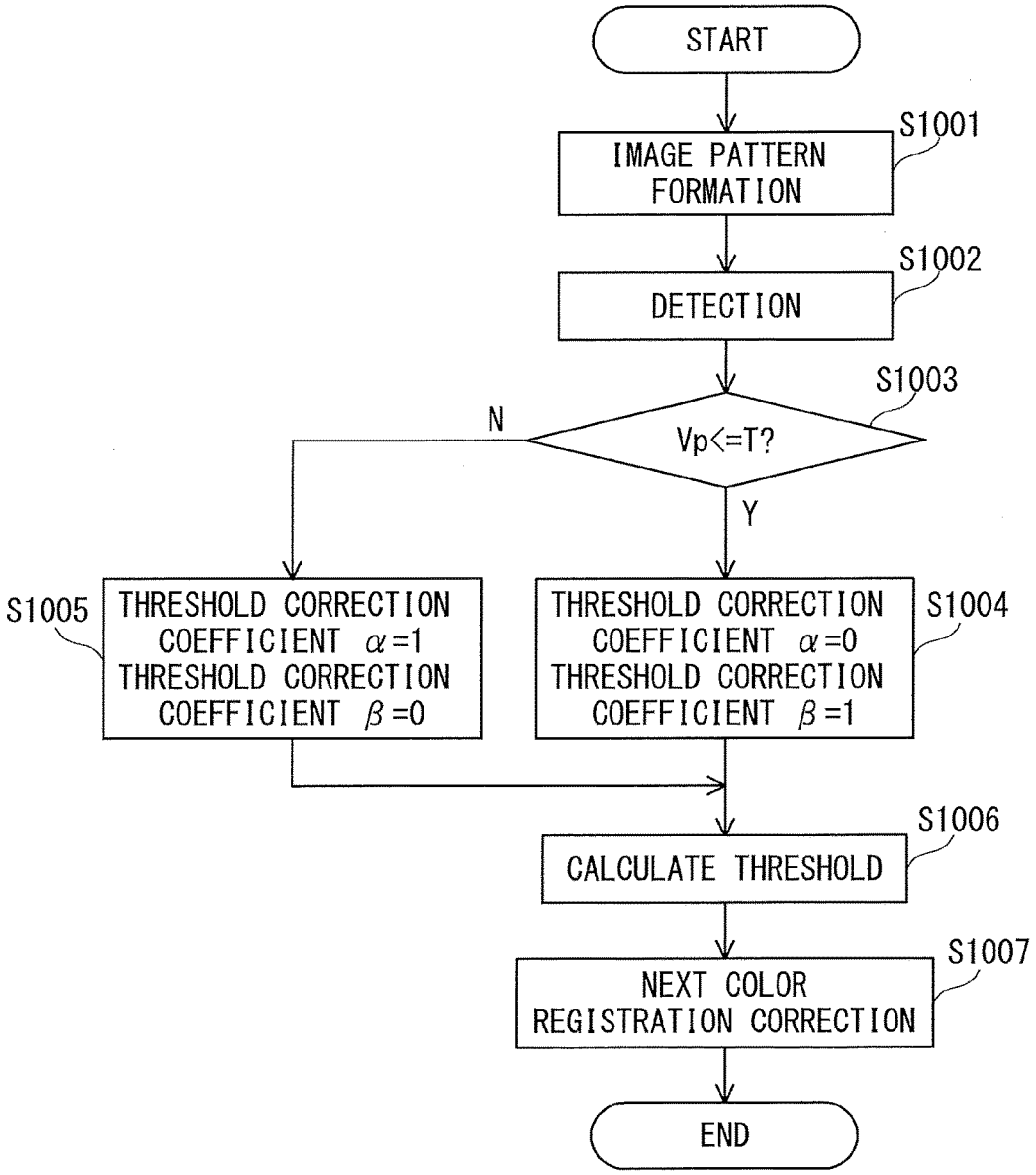
FIG. 11 is a flowchart representing a threshold setting processing.

FIG. 11 is a flowchart representing threshold setting processing by the image forming apparatus 100. In the following description, the image pattern used for the threshold setting processing is also used as the measurement image used for the color misregistration correction control. In the threshold setting processing, for example, the threshold Vth is determined using the detection value of the image pattern NY for yellow formed on the intermediate transfer belt 109 in the color misregistration correction control. With this configuration, it is not necessary to separately form the image pattern for setting the threshold Vth so that the downtime can be suppressed. It is noted that, to determine the threshold Vth, an image which is different from the image pattern N may be formed.

When the threshold setting processing is started, the CPU 401 causes each of the image forming units Y, M, C, and K to form the image patterns NY, NM, NC, and NK for color misregistration detection. Due to this, the image pattern N is formed on the intermediate transfer belt 109 (Step S1001). The optical sensor 113 detects the image pattern N formed on the intermediate transfer belt 109 (Step S1002). The light emitting part 311 is made to emit light by the optical sensor 113. Also, the optical sensor 113 receives the reflected light from the intermediate transfer belt 109 through the light receiving part 312. The light receiving part 312 outputs the analog signal including a detection value Vp in accordance with the reflected light from the image pattern N and a detection value Vb in accordance with the reflected light from the intermediate transfer belt 109. The analog signal is input to the CPU 401 and the comparator 403.

The CPU 401 determines the threshold to be set in the comparator 403 in accordance with the detection value Vp. Thereby, the CPU 401 compares the detection value Vp with a predetermined value T to determine whether the detection value Vp is equal to or less than the predetermined value T or not (Step S1003). The predetermined value T is set in the image forming apparatus 100 in advance, which is a value to determine whether the intermediate transfer belt 109 is just after the start of use or it has changed with time. The predetermined value T is set to the detection value of the image pattern N. The detection value is a detection value when it is predicted that the reduction of the local variation of reflectance of the intermediate transfer belt 109 due to the change with time will not be caused.

If it is determined that the detection value Vp is equal to or less than the predetermined value T (Step S1003: Y), the CPU 401 determines that the intermediate transfer belt 109 is just after the start of use. In this case, the CPU 401 sets a threshold correction coefficient α to "0" (zero) and sets a threshold correction coefficient β to "1" (Step S1004). If it is determined that the detection value Vp is larger than the predetermined value T (Step S1003: N), the CPU 401 determines that the intermediate transfer belt 109 has changed with time. In this case, the CPU 401 sets the threshold correction coefficient α to "1" and sets the threshold correction coefficient β to "0" (Step S1005).

Based on the threshold correction coefficients α and β, the detection values Vp and Vb, a coefficient P, and an initial threshold D, the CPU 401 calculates the threshold Vth for color misregistration correction to be set in the comparator 403 (Step S1006). The coefficient P is a previously determined value. The initial threshold D is a threshold which is previously determined by an experiment. If it is just after the start of use, even the local variation of reflectance of the intermediate transfer belt 109 is caused, the initial threshold D is set to a value which is enough to determine the image pattern and the region of the intermediate transfer belt 109 where the image pattern is not formed. It is noted that the initial threshold D corresponds, for example, to the threshold Vth2 shown in FIG. 8. The CPU 401 calculates the threshold by, for example, a following expression 1. The threshold correction coefficient α is a first coefficient and the threshold correction coefficient β is a second coefficient. The threshold correction coefficients α and β correspond to a determination condition used to determine the threshold Vth. The CPU 401 functions as a generation unit to generate the determination condition based on the detection value of the image pattern N.

$$Vth=\alpha*\{(Vb-Vp)*P+Vp\}+\beta*D \quad \text{(Expression 1)}$$

The CPU 401 sets the calculated threshold in the comparator 403. Based on the set threshold, the comparator 403 converts the analog signal obtained from the optical sensor 113 at the time of next color misregistration correction into the digital signal. The comparator 403 inputs the converted digital signal to the CPU 401. Based on the digital signal obtained from the comparator 403, the CPU 401 performs the color misregistration correction (Step S1007).

As mentioned, in the Step S1003, the CPU 401 determines whether the intermediate transfer belt 109 is just after the start of use or it has changed with time and sets the threshold Vth in accordance with the determination result. It means that, through the above expression, the threshold Vth is fixed to the initial threshold D (predetermined value) if it is determined that the intermediate transfer belt 109 is just after the start of use. If it is determined that the intermediate transfer belt 109 has changed with time, the threshold Vth becomes a variable value which is expressed by the following expression of {(Vb−Vp)*P+Vp}. It is noted that if the detection value Vp is less than or equal to the predetermined value T, the CPU 401 determines the threshold Vth based on an expression 2. If the detection value Vp is larger than the predetermined value T, the CPU 401 determines the threshold Vth based on an expression 3. Here, the expression 2 and the expression 3 correspond to the determination condition used to determine the threshold Vth.

$$Vth=D \quad \text{(Expression 2)}$$

$$Vth=(Vb-Vp)*P+Vp \quad \text{(Expression 3)}$$

Further, if the threshold Vth is equal to or less than the predetermined value T, the CPU 401 sets the predetermined value D to the threshold Vth. If the threshold Vth is larger than the predetermined value T, the CPU 401 sets the threshold Vth based on the detection value Vp. It means that, it is possible to interpret that the CPU 401 controls whether to change the threshold Vth or not based on the detection value Vp at the Step S1003.

Threshold Setting Processing 2

Figure 12:
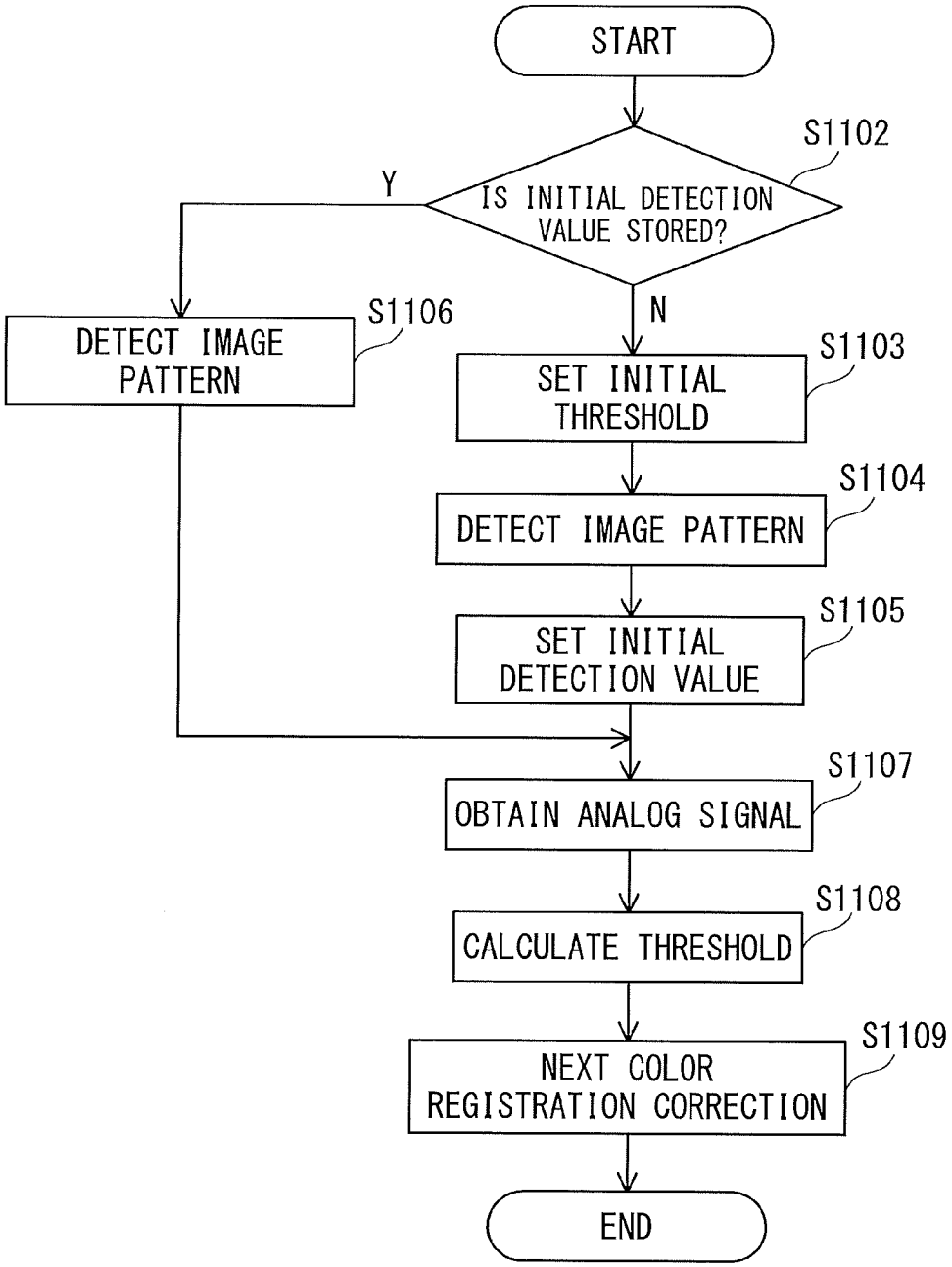
FIG. 12 is a flowchart representing another threshold setting processing.

FIG. 12 is a flow chart representing another threshold setting processing.

The CPU 401 determines whether an initial detection value Vp0 of the image pattern N for color misregistration correction is stored in the memory 402 or not (Step S1102). The initial detection value Vp0 is a detection value of the optical sensor 113 which corresponds to the image pattern N formed at an initial stage of use of the intermediate transfer belt 109. The initial detection value Vp0 is detected when the image forming apparatus is installed and the intermediate transfer belt 109 is replaced, which is then stored in the memory 402.

If the initial detection value Vp0 is not stored in the memory 402 (Step S1102: N), the CPU 401 sets the initial threshold D in the comparator 403 (Step S1103). The CPU 401 forms the image pattern N for color misregistration detection on the intermediate transfer belt 109 in this state and obtains the analog signal which represents the detection value Vp which represents the detection result of the image pattern N from the optical sensor 113 (Step S1104). The CPU 401 sets the obtained detection value Vp as the initial detection value Vp0 (Step S1105).

If the initial detection value Vp0 is stored in the memory 402 (Step S1102: Y), the CPU 401 forms the image pattern N for color misregistration detection on the intermediate transfer belt 109. The CPU 401 obtains the analog signal which represents the detection result of the image pattern N (the detection value Vp) from the optical sensor 113 (Step S1106).

The CPU 401 obtains the analog signal which represents the detection result of the intermediate transfer belt 109 (the detection value Vb) by the optical sensor 113 (Step S1107). Based on the initial detection value Vp0, the detection value Vp, the detection value Vb, the coefficient P, and the initial threshold D, the CPU 401 calculates the threshold Vth for color misregistration correction to be set in the comparator 403 (Step S1108). It is noted that, in a case where the initial detection value Vp0 is not set in the Step S1102, the detection value obtained at the Step S1104 is used. Thereby, the detection value Vp becomes the same value as the initial detection value Vp0 which is set at the Step S1105. For example, the CPU 401 calculates the threshold by an expression 4 as below.

$$Vth=(1-Vp0/Vp)*\{(Vb-Vp)*P+Vp\}+(Vp0/Vp)*D \quad \text{(Expression 4)}$$

The CPU 401 sets the calculated threshold in the comparator 403. Based on the set threshold, the comparator 403 converts the analog signal obtained from the optical sensor 113 at the time of next color misregistration correction into the digital signal. The comparator 403 inputs the converted digital signal to the CPU 401. The CPU 401 performs the color misregistration correction based on the digital signal obtained from the comparator 403 (Step S1109).

As mentioned, the CPU 401 determines whether the intermediate transfer belt 109 is just after the start of use or it has changed with time by the difference between the detection value Vp and the initial detection value Vp0 stored in the memory 402 and sets the threshold Vth in accordance with the determination result. If it is determined that the intermediate transfer belt 109 is just after the start of use (Vp0=Vp), the threshold Vth is fixed to the initial threshold D by the expression 4. If it is determined that the intermediate transfer belt has changed with time (Vp0≠Vp), the threshold Vth becomes the variable value which is expressed by the following expression.

$$(1-Vp0/Vp)*\{(Vb-Vp)*P+Vp\}+(Vp0/Vp)*D$$

With the above processing, just after the start of use of the intermediate transfer belt 109, the threshold of the fixed value is set in the comparator 403. After the intermediate transfer belt 109 has changed with time, the threshold is set to the variable value which is higher than the fixed value. Due to this, even in a case where the state of the intermediate transfer belt 109 is changed, it is possible to accurately detect the image pattern for color misregistration correction, which allows the accurate color misregistration correction.

While the present invention has been described with reference to exemplary embodiments and it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-007418, filed Jan. 18, 2016 which is hereby incorporated by reference herein in its entirety.

What is claimed is:

1. An image forming apparatus comprising:

a plurality of image forming units configured to form images, each having a different color;

an intermediate transfer member to which a pattern formed by the plurality of image forming units is transferred, the pattern being used for detecting color misregistration;

a sensor configured to measure reflected light from the pattern on the intermediate transfer member to output an output value in accordance with a measurement result;

a comparator configured to compare the output value output from the sensor with a threshold value; and a controller configured:

to control the plurality of image forming units to form a plurality of patterns, each having a different color, on the intermediate transfer member, to control the sensor to measure reflected light from the plurality of patterns, to compare an output value corresponding to the plurality of patterns output from the sensor with the threshold value using the comparator, to detect an amount of color misregistration, related to a relative position of a pattern having a reference color among the plurality of patterns and a color pattern having another color among the plurality of patterns based on a comparison result of the comparator, and to correct an image forming position of the other color based on the amount of color misregistration, wherein, in a case where a first output value from the sensor satisfies a predetermined condition, the controller sets a fixed value as the threshold value, the first output value corresponding to a measurement result of reflected light from another pattern which differs from each of the plurality of patterns, and wherein, in a case where the first output value does not satisfy the predetermined condition, the controller sets the threshold value based on the first output value and a second output value from the sensor, the second output value corresponding to a measurement result of reflected light from the intermediate transfer member.

2. The image forming apparatus according to claim 1, wherein the other pattern corresponds to a plurality of patterns previously formed by the plurality of image forming units.

3. The image forming apparatus according to claim 1, wherein the sensor includes a light emitting part which emits light toward the intermediate transfer member, and wherein the controller is further configured to control a light emitting amount of the light emitting part based on the measurement result of the reflected light from the intermediate transfer member.

4. The image forming apparatus according to claim 1, wherein the output value output from the sensor includes the output value corresponding to the measurement result of the reflected light from the plurality of patterns and the output value corresponding to the measurement result of the reflected light from the intermediate transfer member.

5. The image forming apparatus according to claim 1, wherein in a case where the first output value is less than a predetermined value, the first output value satisfies the predetermined condition, and in a case where the first output value is greater than the predetermined value, the first output value does not satisfy the predetermined condition.

6. The image forming apparatus according to claim 1, wherein the sensor measures regular reflected light from the pattern.

7. An image forming apparatus comprising:

a plurality of image forming units configured to form images, each having a different color, on a sheet;

an intermediate transfer member to which a pattern formed by the plurality of image forming units is transferred, the pattern being used for detecting color misregistration;

a sensor configured to measure reflected light from the pattern on the intermediate transfer member to output an output value in accordance with a measurement result;

a comparator configured to compare the output value output from the sensor with a threshold value; and a controller configured:

to control the plurality of image forming units to form a plurality of patterns, each having a different color, on the intermediate transfer member;

to control the sensor to measure reflected light from the plurality of patterns;

to obtain a comparison result of the comparator, and to control the detected color misregistration based on the comparison result of the comparator, wherein the controller determines the threshold value of the comparator based on a first output value and a second output value, the first output value corresponding to a measurement result of reflected light from another pattern which differs from each of the plurality of patterns, and the second output value corresponding to a measurement result of reflected light from the intermediate transfer member, and wherein the controller sets a coefficient, which is used for determining the threshold value of the comparator, based on the first output value.

8. The image forming apparatus according to claim 7, wherein the coefficient includes a first coefficient and a second coefficient.

9. The image forming apparatus according to claim 7, wherein the coefficient includes a first coefficient and a second coefficient, in a case where the first output value is greater than a predetermined value, the first coefficient is greater than the second coefficient, and in a case where the first output value is less than the predetermined value, the second coefficient is greater than the first coefficient.

10. The image forming apparatus according to claim 7, wherein the coefficient includes a first coefficient and a second coefficient, in a case where the first output value is greater than a predetermined value, the first coefficient is greater than the second coefficient, in a case where the first output value is greater than the predetermined value, the second coefficient is set to 0, in a case where the first output value is less than the predetermined value, the second coefficient is greater than the first coefficient, and in a case where the first output value is less than the predetermined value, the first coefficient is set to 0.

* * * * *